US012134839B2

(12) United States Patent
Yoshioka

(10) Patent No.: US 12,134,839 B2
(45) Date of Patent: Nov. 5, 2024

(54) METHOD OF MANUFACTURING CUSHIONING MATERIAL, AND CUSHIONING MATERIAL

(71) Applicant: SEIKO EPSON CORPORATION, Tokyo (JP)

(72) Inventor: Satomi Yoshioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 61 days.

(21) Appl. No.: 18/161,109

(22) Filed: Jan. 30, 2023

(65) Prior Publication Data

US 2023/0243091 A1 Aug. 3, 2023

(30) Foreign Application Priority Data

Jan. 31, 2022 (JP) ..... 2022-012885

(51) Int. Cl.

| | |
|---|---|
| ***D01G 11/04*** | (2006.01) |
| ***D01G 13/00*** | (2006.01) |
| ***D01G 21/00*** | (2006.01) |
| ***D21B 1/06*** | (2006.01) |
| *D06M 14/04* | (2006.01) |
| *D06M 14/06* | (2006.01) |

(52) U.S. Cl.

CPC ..... *D01G 11/04* (2013.01); *D01G 13/00* (2013.01); *D01G 21/00* (2013.01); *D21B 1/06* (2013.01); *D06M 14/04* (2013.01); *D06M 14/06* (2013.01); *D10B 2201/02* (2013.01); *D10B 2211/02* (2013.01)

(58) Field of Classification Search

CPC ..... D01G 11/04; D01G 13/00; D01G 21/00; D21B 1/06

See application file for complete search history.

(56) References Cited

U.S. PATENT DOCUMENTS

| | | | | |
|---|---|---|---|---|
| 2016/0002829 | A1* | 1/2016 | Lightman | D04H 1/04 19/65 R |
| 2017/0081794 | A1* | 3/2017 | Yamagami | D21B 1/06 |
| 2020/0077216 | A1* | 3/2020 | Yoshioka | B32B 7/02 |
| 2020/0114594 | A1* | 4/2020 | Ota | B29C 70/46 |

FOREIGN PATENT DOCUMENTS

| | | |
|---|---|---|
| JP | 2001-226864 A | 8/2001 |

* cited by examiner

*Primary Examiner* — Shaun R Hurley

(74) *Attorney, Agent, or Firm* — Global IP Counselors, LLP

(57) ABSTRACT

A method of manufacturing a cushioning material P includes a defibrating step of defibrating a cloth to produce fibers F in dry forming, a mixing step of mixing the fibers F with a bonding agent to produce a mixture, an accumulation step of accumulating the mixture in air to produce a web W, and a first forming step of pressurizing and heating the web W to form the web W.

8 Claims, 5 Drawing Sheets

METHOD OF MANUFACTURING CUSHIONING MATERIAL, AND CUSHIONING MATERIAL

The present application is based on, and claims priority from JP Application Serial Number 2022-012885, filed Jan. 31, 2022, the disclosure of which is hereby incorporated by reference herein in its entirety.

BACKGROUND

1. Technical Field

The present disclosure relates to a method of manufacturing a cushioning material and relates to a cushioning material.

2. Related Art

Methods of manufacturing cushioning materials containing fibers and resins are known. For example, JP-A-2001-226864 discloses a method of manufacturing an elastic fibrous structure containing fibers derived from natural products and biodegradable heat-bonding synthetic fibers. This elastic fibrous structure can be used for cushioning materials or the like.

With the manufacturing method described in JP-A-2001-226864, however, increasing mechanical strength of cushioning materials is difficult. More specifically, various types of fibers are mixed and processed in a carding machine and then laid, and thus the fiber length directions tend to align in a direction intersecting the layer direction and the fibers tangle each other less. Accordingly, the mechanical strength of the cushioning material is insufficient and the cushioning material may be deformed by external forces. In other words, a method of manufacturing a cushioning material with increased mechanical strength is desired.

SUMMARY

According to an aspect of the present disclosure, a method of manufacturing a cushioning material includes a defibrating step of defibrating a cloth to produce fibers in dry forming, a mixing step of mixing the fibers with a bonding agent to produce a mixture, an accumulation step of accumulating the mixture in air to produce a web, and a first forming step of pressurizing and heating the web to form the web.

According to another aspect of the present disclosure, a cushioning material includes fibers defibrated from a cloth containing a plain weave fabric or a knit fabric, and a bonding agent that bonds the fibers, the bonding agent derived from a natural product. The cushioning material has a concave portion having a shape conforming to a three-dimensional shape of an object to be packed.

DESCRIPTION OF EXEMPLARY EMBODIMENTS

Figure 1:
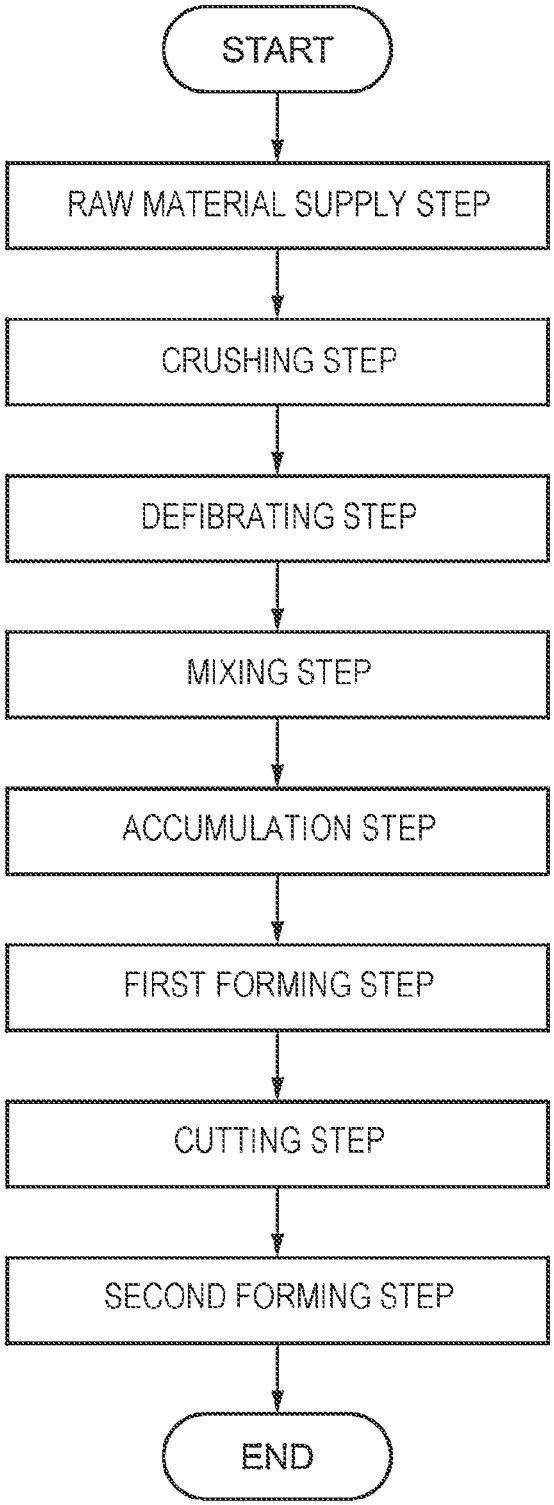
FIG. 1 is a flowchart illustrating a method of manufacturing a cushioning material according to an embodiment.

In the embodiments described below, a method of manufacturing a cushioning material for accommodating a three-dimensional object will be described with reference to the drawings. In the drawings below, the Z-axis, which is a coordinate axis, is given as necessary. The direction indicated by the arrow denotes a +Z direction and the opposite direction denotes a −Z direction. The +Z direction may be referred to as upward, and the −Z direction may be referred to as downward. It should be noted that in FIG. 2, the vertical direction corresponds to the −Z direction.

For convenience of illustration, the size of each component may be different from its actual size. In a cushioning material manufacturing apparatus, a direction in which a raw material, a web, or the like is transported may be referred to as downstream, and a direction opposite to the transport direction may be referred to as upstream.

1. Cushioning Material

A cushioning material produced in accordance with a cushioning material manufacturing method according to the embodiment contains fiber and a bonding agent as raw materials. Such fiber and such a bonding agent are derived from natural products from the viewpoint of environmental load reduction. The fiber and the bonding agent may be biodegradable.

Fiber is a main ingredient of the cushioning material and, together with the bonding agent, affects physical properties, such as mechanical strength, of a cushioning material. A cloth is defibrated into fibers and the defibrated fibers are used. Cloths may be old clothing, such as used clothing, from the viewpoint of resource reuse.

Example cloths may include knit fabric, plain weave fabric, and pile fabric. In addition, example cloths may include nonwoven fabric.

Example fiber may be textile materials derived from natural products, such as cotton, hemp, wool, silk, regenerated cellulose, or the like. Example fiber may be one of these materials used alone or may be two or more of these materials used in combination. In particular, among these textile materials, cloths may contain cotton or wool from the viewpoint of the ease of obtaining used clothing and the physical properties of fiber.

Example fiber may contain synthetic fiber, such as polypropylene, polyester, or polyurethane; however, only fiber derived from natural products may be used from the viewpoint of environmental load reduction.

A bonding agent bonds fibers in a cushioning material. The bonding agent may be a thermoplastic resin or a thermosetting resin. Example resins may include shellac, pine resin, dammar, polylactic resin, plant-derived polybutylene succinate, plant-derived polyethylene, or PHBH (registered trademark) (poly(3-hydroxybutyrate-co-3-hydroxyhexanoate)) from Kaneka Corporation. An example of a bonding agent may be one of these resins used alone or may be two or more of these resins used in combination. In particular, the bonding agent may be a biodegradable resin from the viewpoint of environmental load reduction.

In addition to fiber and a bonding agent, cushioning materials may contain an additive. Example additives may include colorants, flame retardants, antioxidants, UV absorbers, aggregation inhibitors, antibacterial agents, fungicides, waxes, or mold release agents.

A cushioning material is manufactured by using any of the above-described raw materials. The cushioning material has a concave portion for accommodating and protecting an object to be packed. The cushioning material is subjected to a first forming process and is formed into a plate shape or a lump, and is subjected to a second forming process, such as compression molding, to form a concave portion that has a shape conforming to a three-dimensional shape of the object to be packed. This cushioning material manufacturing method will be described in detail below.

The shape of a concave portion may be a desired shape that conforms to a three-dimensional shape of an object to be packed. To form a desired shape, it is necessary to properly reflect the shape of a mold in the concave portion in the compression molding process. Accordingly, the cushioning material is required to have increased conformability to the mold while being resistant to the occurrence of unintended deformation due to pressure from the mold. In other words, conformability to a mold is an important physical property of the mechanical strength of the cushioning material.

Example objects to be packed include watches, laptop computers, small game consoles, smart phones, printers, projectors and other information terminal equipment, precision components, models, ceramics, porcelain, glassware, domestic appliances, and produce.

2. Method of Manufacturing Cushioning Material

As illustrated in FIG. 1, a method of manufacturing a cushioning material according to the embodiment includes a raw material supply step, a crushing step, a defibrating step, a mixing step, an accumulation step, a first forming step, a cutting step, and a second forming step.

According to the cushioning material manufacturing method, a cushioning material is manufactured through each step in the above-described order, from the upstream raw material supply step to the downstream second forming step. It should be noted that the cushioning material manufacturing method according to the embodiment of the present disclosure includes the defibrating step, the mixing step, the accumulation process, and the first forming step, and the other steps are not limited to the above-described examples. In addition, a cushioning material that has been subjected to the first forming step and has not yet been subjected to the second forming step may be used for a cushioning material according to the embodiment of the present disclosure. A cushioning material that has not yet been subjected to the second forming step has been formed into a plate shape or a lump.

A specific example of the cushioning material manufacturing method is described together with a cushioning material manufacturing apparatus. It should be noted that a cushioning material manufacturing apparatus 1 according to the embodiment is merely an example and is not limited to this example.

Figure 2:
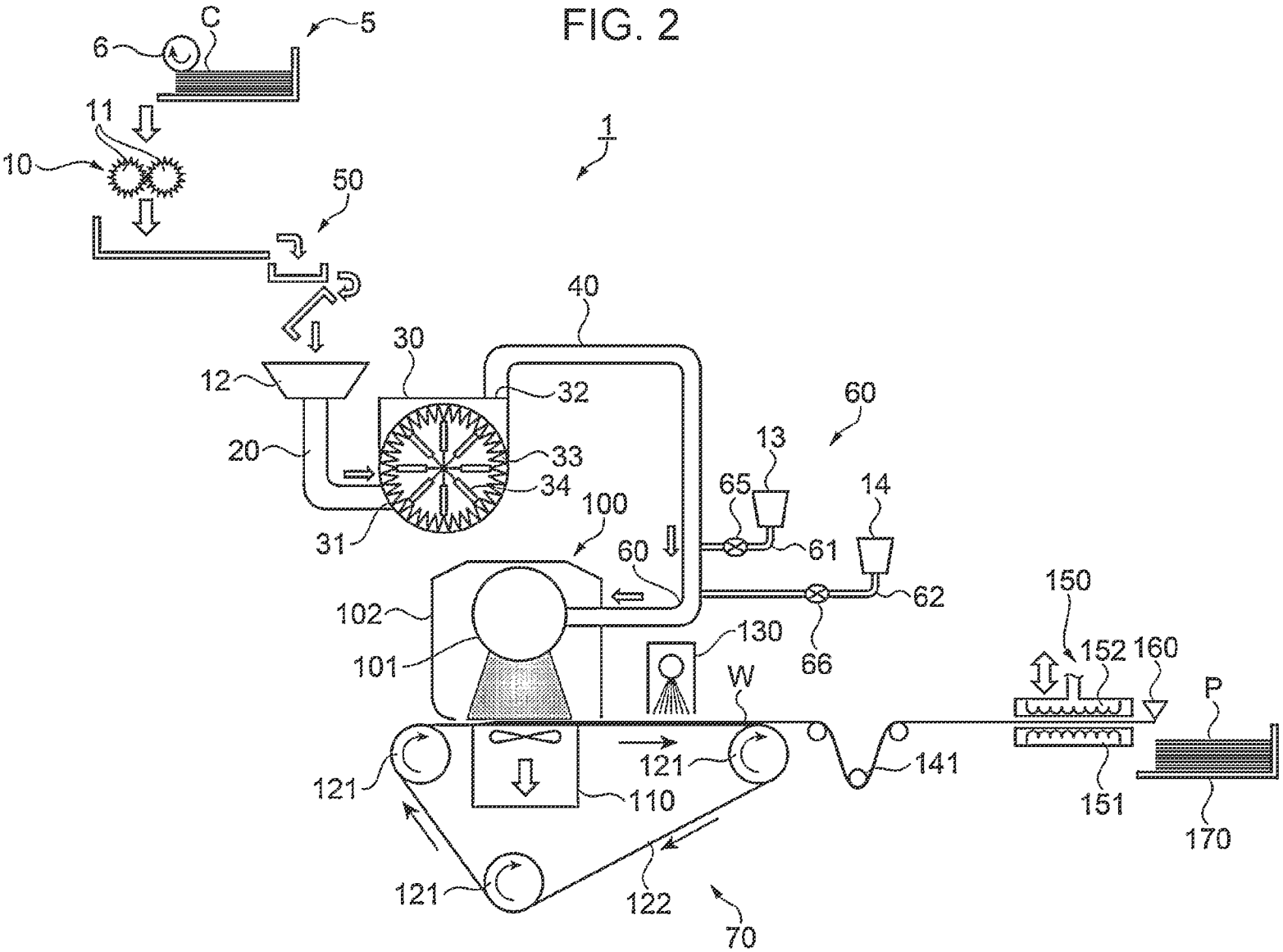
FIG. 2 is a schematic view illustrating a configuration of a cushioning material manufacturing apparatus.

The cushioning material manufacturing apparatus 1 includes, from upstream to downstream, a feeding section 5, a crushing section 10, a defibrating section 30, a mixing section 60, an accumulation section 100, a web transport section 70, a first forming section 150, and a cutting section 160, as illustrated in FIG. 2. The cushioning material manufacturing apparatus 1 also includes a controller (not illustrated in FIG. 2) that performs overall control of the operation of the above-described structures. The cushioning material manufacturing method according to the embodiment employs a compression molding machine that performs a second forming step on a plate-shaped cushioning material P manufactured by the cushioning material manufacturing apparatus 1. The compression molding machine is a known machine.

The feeding section 5 performs the raw material supply step. The feeding section 5 supplies a raw material to the crushing section 10. The feeding section 5 includes, for example, an automatic feeder 6, and automatically and continuously feeds a cloth C, which is a raw material, to the crushing section 10. The cloth C is a material containing the above-described fiber.

The crushing section 10 performs the crushing step. The crushing section 10 crushes a cloth C supplied from the feeding section 5 into small pieces in an atmosphere such as air. The crushing section 10 may be a shredder or cutter mill that includes crushing blades 11. A cloth C is crushed by the crushing blades 11 into small pieces. Planes of the small pieces may be squares of several millimeters or may be irregularly shaped. The small pieces are gathered into a volumetric feeder 50.

The volumetric feeder 50 measures the small pieces and supplies a specific volume of small pieces to a hopper 12. The volumetric feeder 50 is, for example, a vibrating feeder. Small pieces fed into the hopper 12 are transported through a tube 20 to an inlet 31 of the defibrating section 30.

The defibrating section 30 performs the defibrating step. The defibrating section 30 defibrates small pieces of the cloth C to produce fibers in dry forming. The defibrating section 30 includes the inlet 31, an outlet 32, a stator 33, a rotor 34, and an airflow generating mechanism (not illustrated). Small pieces of the cloth C are led through the inlet 31 into the defibrating section 30 by an airflow generated by the airflow generating mechanism. The dry forming in this specification is a process performed not in a liquid but in air, such as in the atmosphere.

The stator 33 and the rotor 34 are disposed in the defibrating section 30. The stator 33 has a substantially cylindrical inner surface. The rotor 34 rotates along the inner surface of the stator 33. Small pieces of the cloth C are held by the stator 33 and the rotor 34 and defibrated by a shearing force produced between the stator 33 and the rotor 34.

Defibrated fibers may have a length-weighted mean length of 1.0 mm or greater and may have a longest fiber length of 5.0 mm or greater. Such fibers are not too short, and the mechanical strength of the cushioning material P can be further increased. A length-weighted mean length of fibers is obtained in accordance with the method set forth in ISO 16065-2: 2007.

The longest fiber length of fibers is obtained in accordance with the following method. Fibers are mounted on a glass plate such that the fibers overlap as little as possible. In this state, lengths of the fibers on the glass plate are measured by using a digital microscope VHX-5000 (Keyence Corporation). More specifically, a length of a fiber in a digital photo captured by the microscope is measured by using measurement software included with the device. This operation is performed on 50 arbitrary fibers taken randomly, and the length of the longest fiber is determined as the longest fiber length. A fiber length is a distance along a curve when the fiber curves.

An aspect ratio of a fiber may be 0.9 or less. An aspect ratio of a fiber is obtained by dividing a fiber shortest length by a fiber length. Accordingly, the cushioning material P contains curved or bent fibers, enabling the fibers in the cushioning material P to be less unevenly distributed in their orientation directions and to readily tangle with each other. Such fibers further increase the mechanical strength of the cushioning material P.

An aspect ratio of a fiber is obtained in accordance with the following method. An image of fibers mounted on a glass plate is captured similarly to the case of the above-described longest fiber length. A fiber shortest length is a distance in a straight line between both ends of a fiber. A fiber length and a fiber shortest length in the digital photo are measured by using the measurement software included with the device. This operation is performed on 50 arbitrary fibers taken randomly, and a mean value of the 50 fibers is calculated as the aspect ratio of fibers.

The fibers produced in the defibrating section 30 are discharged from the outlet 32 into a tube 40. The tube 40 communicates with the inside of the defibrating section 30 and the inside of the accumulation section 100. Fibers are sent from the defibrating section 30 to the accumulation section 100 by an airflow generated by the airflow generating mechanism. The mixing section 60 is disposed in the tube 40 between the defibrating section 30 and the accumulation section 100.

The mixing section 60 performs the mixing step. The mixing section 60 mixes fibers and a bonding agent in air to produce a mixture. The mixing section 60 includes hoppers 13 and 14, supply tubes 61 and 62, and valves 65 and 66.

The hopper 13 communicates with the inside of the tube 40 via the supply tube 61. The valve 65 is disposed in the supply tube 61 between the hopper 13 and the tube 40. The hopper 13 supplies the bonding agent into the tube 40. The valve 65 adjusts the weight of the bonding agent to be supplied from the hopper 13 to the tube 40, thereby adjusting a mixing ratio of fibers and the bonding agent. The bonding agent may be supplied in a form of powder or in a melted state.

The hopper 14 communicates with the inside of the tube 40 via the supply tube 62. The valve 66 is disposed in the supply tube 62 between the hopper 14 and the tube 40. The hopper 14 supplies additives other than the bonding agent into the tube 40. The valve 66 adjusts the weight of the additives to be supplied from the hopper 14 to the tube 40, thereby adjusting a mixing ratio of the additives to fibers and the bonding agent. It should be noted that the additives are not essential ingredients for the cushioning material P, and the hopper 14, the supply tube 62, and other components may be omitted. In addition, additives may be mixed with the bonding agent in advance and supplied from the hopper 13.

Fibers, the bonding agent, and other ingredients are mixed into a mixture while being sent through the tube 40 to the accumulation section 100. A blower or other devices for generating airflow in the tube 40 may be provided to enhance the mixture production and the ability to send the mixture in the tube 40. The mixture is sent through the tube 40 to the accumulation section 100.

The accumulation section 100 performs the accumulation step. The accumulation section 100 accumulates the mixture containing fibers, the bonding agent, and other ingredients in air to produce a web W. The accumulation section 100 includes a drum section 101 and a housing section 102 that houses the drum section 101. The accumulation section 100 takes the mixture from the tube 40 into the drum section 101 and accumulates the mixture on a mesh belt 122 in dry forming.

The web transport section 70 including the mesh belt 122 and a suction mechanism 110 is disposed below the accumulation section 100. The suction mechanism 110 is disposed to face the drum section 101 in the Z-axis direction, with the mesh belt 122 therebetween.

The drum section 101 is a columnar screen that is driven by a motor (not illustrated) to rotate. A net having a function of a screen is provided on a side of the columnar drum section 101. The drum section 101 passes fibers and mixture particles smaller than the mesh size of the net of the screen from the inside to the outside. Tangled fibers in the mixture are disentangled by the drum section 101 and are spread in air in the housing section 102.

Fibers are spread in air in the housing section 102 and randomly accumulate on the mesh belt 122. Accordingly, fibers are less oriented in a particular direction in the web W.

The function of the screen of the drum section 101 for screening large fibers or the like in a mixture may be omitted. In other words, the drum section 101 may disentangle fibers in a mixture and pass all of the mixture into the housing section 102. The mixture spread in air in the housing section 102 accumulates on an upper surface of the mesh belt 122 due to gravity and suction of the suction mechanism 110.

A mass ratio of fibers to the bonding agent in the web W may be within the range of 15:85 to 45:55. Such a web W can ensure various physical properties of the cushioning material P including the mechanical strength. The density and thickness of the cushioning material P to be manufactured are adjusted depending on a mass per unit area of the web W.

The web transport section 70 includes the mesh belt 122 and the suction mechanism 110. The web transport section 70 enhances accumulation of the mixture on the mesh belt 122 by using the suction mechanism 110. The web transport section 70 transports downstream the web W formed of the mixture by rotating the mesh belt 122.

The suction mechanism 110 is disposed below the drum section 101. The suction mechanism 110 sucks the air in the housing section 102 through holes of the mesh belt 122, and thereby the mixture discharged to the outside of the drum section 101 is sucked downward together with the air and accumulates on the upper surface of the mesh belt 122. The suction mechanism 110 is a known suction device, such as a blower.

The holes in the mesh belt 122 allow air to pass through but do not allow some fibers and bonding agents contained in a mixture to pass through. The mesh belt 122 is an endless belt and is stretched by three stretch rollers 121.

The upper surface of the mesh belt 122 is moved downstream by the rotation of the stretch rollers 121. In other words, the mesh belt 122 rotates in the clockwise direction in FIG. 2. The mesh belt 122 is rotated by the stretch rollers 121, thereby allowing the mixture to continuously accumulate to produce a web W. The web W contains a relatively large amount of air and is soft and puffy. The web W is transported downstream as the mesh belt 122 moves.

Here, the web W may be laminated with a nonwoven fabric or the like. More specifically, a nonwoven fabric may be provided between the mesh belt 122 and the web W when the web W is accumulated on the mesh belt 122. In addition, an upper surface of the web W may be covered with a nonwoven fabric. By continuously providing the nonwoven fabrics under and over the web W, the web W is laminated by the nonwoven fabrics. The production of the cushioning material P may be started from the web W in this state.

Nonwoven fabrics used for lamination may be nonwoven fabrics made of polylactic acid and fiber, such as cellulose or recycled cellulose. Such nonwoven fabrics, together with the raw materials contained in the web W, enhance environmental load reduction.

A humidifier 130 may be disposed downstream of the accumulation section 100 to spray water over the web W on the mesh belt 122 to humidify the web W, and thereby release of airborne fibers and the bonding agent contained in the web W can be suppressed from occurring. In addition to the humidification, a water-soluble additive or the like may be added to the water for humidification so that the web W contains the additive while the humidification is being performed.

The web W is transported downstream by the mesh belt 122 and removed from the mesh belt 122 and pulled by a dancer roller 141. The dancer roller 141 is disposed to ensure processing time for the first forming process performed in a downstream process. More specifically, the first forming step performed after the accumulation step is batch processing, and thus the dancer roller 141 is moved upward and downward with respect to the web W continuously supplied from the accumulation section 100 to ensure the processing time for the first forming step. The web W is moved via the dancer roller 141 to the first forming section 150.

The first forming section 150 performs the first forming step. The web W is heated and pressurized to form a cushioning material P in a form of continuous paper in the first forming step. The first forming section 150 is a hot-press device and includes an upper plate 152 and a lower plate 151. The upper plate 152 and the lower plate 151 hold and pressurize the web W therebetween and heat the web W by using a built-in heater.

The web W is compressed upward and downward to increase the density and is heated to meld the bonding agent to become wet and spread into fibers. The heating process is ended in this state for the resin to solidify, thereby bonding the fibers with the bonding agent. It should be noted that the first forming step may be performed continuously by using a heating roller.

The conditions for pressurization and heating in the first forming section 150 are appropriately adjusted in accordance with, for example, a desired density of the cushioning material P and a melting point of a resin, which is a bonding agent. Although such conditions are not particularly limited, the condition for pressurization may be 0.1 MPa or greater, and the condition for heating may be 90° C. or greater. The web W is formed into a cushioning material P in the form of continuous paper by the first forming section 150 and is sent to the cutting section 160.

The cutting section 160 performs the cutting step. The cutting section 160 cuts the continuous cushioning material P into plate-shaped single sheets of cushioning material P. Although not illustrated, the cutting section 160 includes a vertical cutting blade and a horizontal cutting blade.

The vertical cutting blade cuts the cushioning material P in a direction in which the continuous cushioning material P is transported. The horizontal cutting blade cuts the cushioning material P in a direction intersecting the direction in which the continuous cushioning material P is transported. By using the cutting blades, substantially plate-shaped cushioning materials P are manufactured and mounted on a tray 170.

After the first forming step, a concave portion is formed by pressurizing a predetermined portion on the plate-shaped cushioning material P in the second forming step. More specifically, a concave portion is formed by using a compression molding machine. As described above, the concave portion is formed to conform to a three-dimensional shape of an object to be packed. The conformability to the mold in compression molding is influenced by the mechanical strength of the cushioning material P. The mechanical strength is influenced by the type and spreading state of fibers in the cushioning material P. In addition, a convex portion may be formed together with the concave portion. It should be noted that the −Z direction is not limited to the vertical direction in FIG. 3 to FIG. 8 referenced in the following description.

Figure 7:
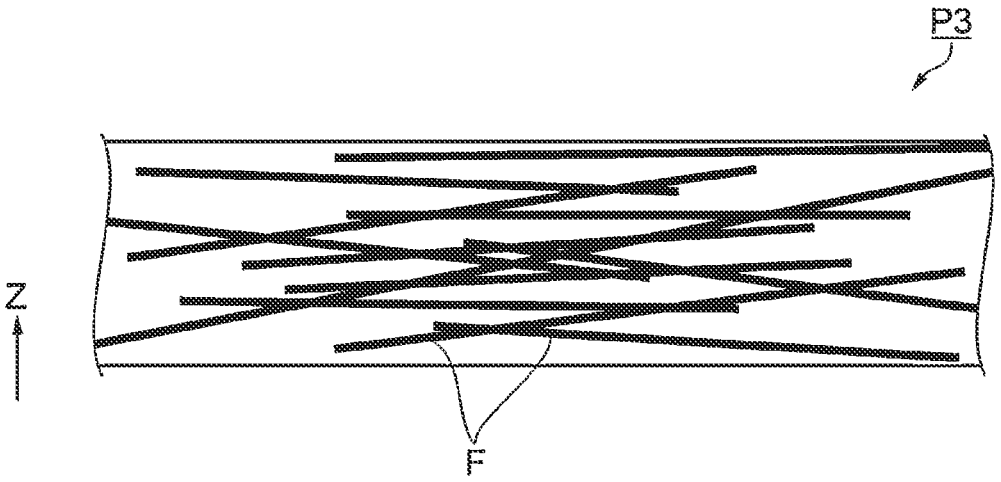
FIG. 7 is a schematic cross-sectional view illustrating a state of fibers in a plate-shaped cushioning material according to a known art.

As illustrated in FIG. 7, fibers F are oriented substantially along a plane orthogonal to the Z-axis in a plate-shaped cushioning material P3 according to a known art. Furthermore, the fibers F are less tangled and interfere less with each other. This is because the fibers F are processed by a carding machine and layered.

Figure 8:
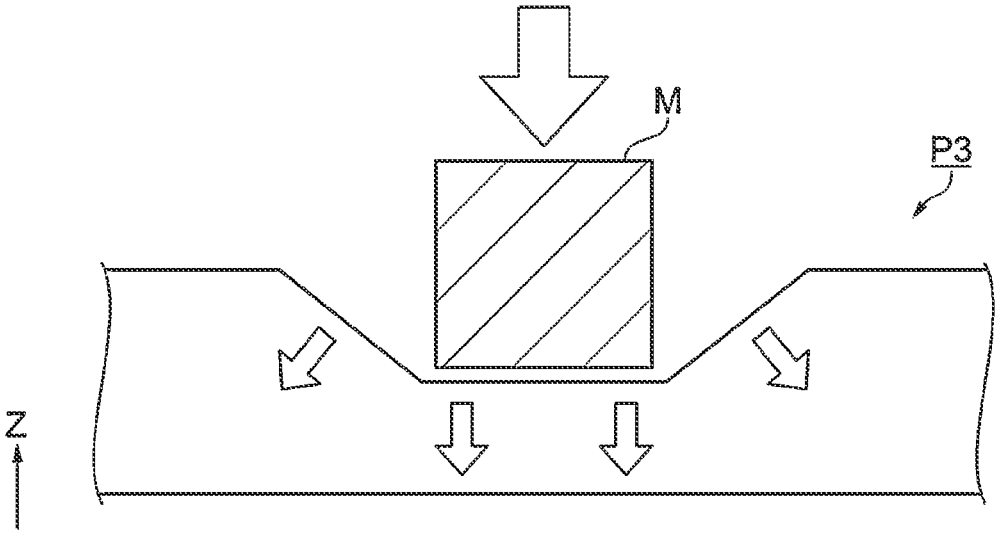
FIG. 8 is a schematic view illustrating the cushioning material in FIG. 7 that conforms to a mold in compression molding.

As illustrated in FIG. 8, when the cushioning material P3 is subjected to compression molding by using a mold M in the −Z direction, an area around the area in contact with the mold M is largely indented. This is because the compressive force of the mold M disperses and is distributed due to the orientation state and features of the fibers F in the cushioning material P3. These features of the fibers F here include the above-described length-weighted mean length, longest fiber length, and aspect ratio.

It should be noted that in compression molding, the cushioning material P3 is heated and resins in the cushioning material P3 do not contribute to the mechanical strength in compression molding. Accordingly, it is difficult to increase the mechanical strength of the known cushioning material P3, and its conformability to the mold tends to be low.

On the other hand, aligning the orientation directions of fibers F is difficult, and the fibers F are less oriented in a particular direction in the cushioning materials P1 and P2, which are example plate-shaped cushioning materials P according to the embodiment. Since the above-described accumulation step is performed in air, the fibers F randomly accumulate compared with the case in which the fibers are processed by a carding machine and layered. In addition, the fibers F are subjected to the defibrating step, and thus the length-weighted mean length and longest fiber length of the fibers F are shorter than those of fibers that are not subjected to the defibrating step.

Figure 3:
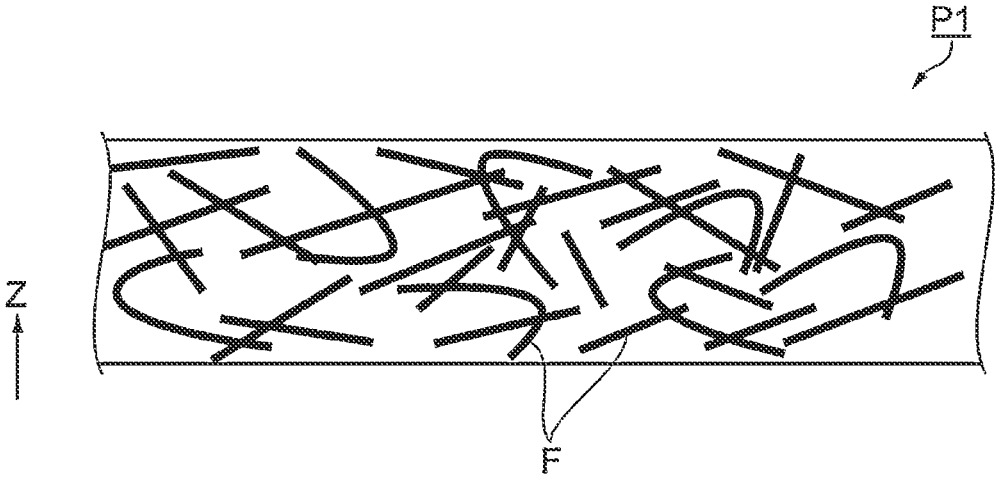
FIG. 3 is a schematic cross-sectional view illustrating a state of fibers in a plate-shaped cushioning material.

When a knit fabric is used as a raw material of fibers F, many curved fibers F are contained in the cushioning material P1, as illustrated in FIG. 3. Such a knit fabric is made with looping yarn, and portions of the looping yarn in the knit fabric are the curved fibers F. Accordingly, fibers F made from a knit fabric tend to have a small aspect ratio.

Fibers F according to the embodiment that are spread in air accumulate to produce a web W in the accumulation step. Accordingly, the fibers F are less oriented in a particular direction in the cushioning material P1. The cushioning material P1 thus includes randomly spread relatively short fibers F, curved fibers F, and straight fibers F, which relatively tangle with each other. As a result, the cushioning material P1 has an increased mechanical strength compared with the known cushioning material P3.

Figure 4:
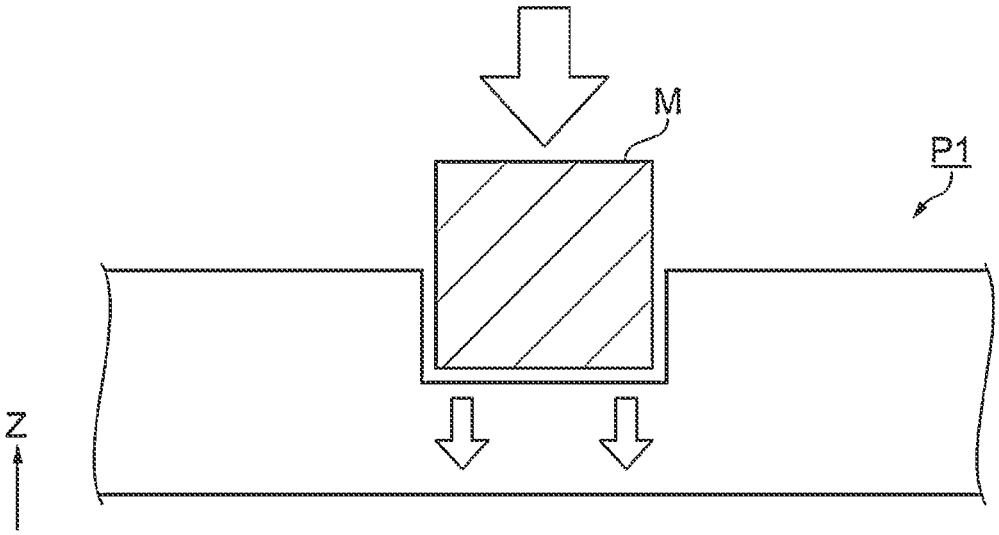
FIG. 4 is a schematic view illustrating the cushioning material in FIG. 3 that conforms to a mold in compression molding.

As illustrated in FIG. 4, when the cushioning material P1 is subjected to compression molding in the −Z direction by using the mold M, an area around the area in contact with the mold M is less indented. This is because the compressive force of the mold M is less distributed due to the spreading state and features of the fibers F in the cushioning material P1. Such fibers F enable the cushioning material P1 to have higher mechanical strength and increased conformability to the mold.

Figure 5:
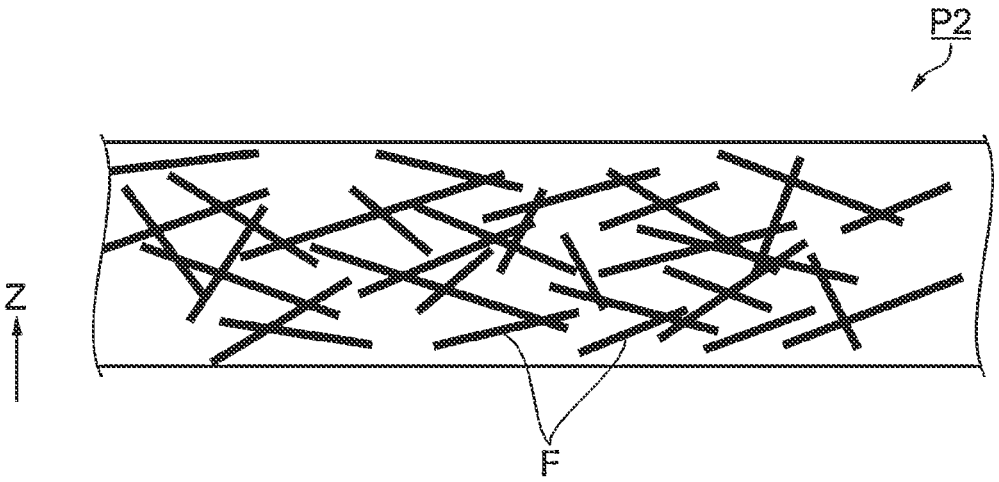
FIG. 5 is a schematic cross-sectional view illustrating a state of fibers in a plate-shaped cushioning material.

When a plain weave fabric is used as a raw material of fibers F, relatively short fibers F are contained in a randomly spread state in the cushioning material P2, as illustrated in FIG. 5. Such fibers F contains curved fibers F although their amount is less than that in knit fabrics. Such a plain weave fabric is made with the warp and weft threads crossed each other, and portions of the crossing warp and weft threads in the plain weave fabric tend to be the curved fibers F.

Fibers F according to the embodiment that are spread in air accumulate to form a web W in the accumulation step. Accordingly, the fibers F are less oriented in a particular direction in the cushioning material P2. The cushioning material P2 thus includes randomly spread relatively short fibers F, which relatively tangle with each other. As a result, the cushioning material P2 has an increased mechanical strength compared with the known cushioning material.

Figure 6:
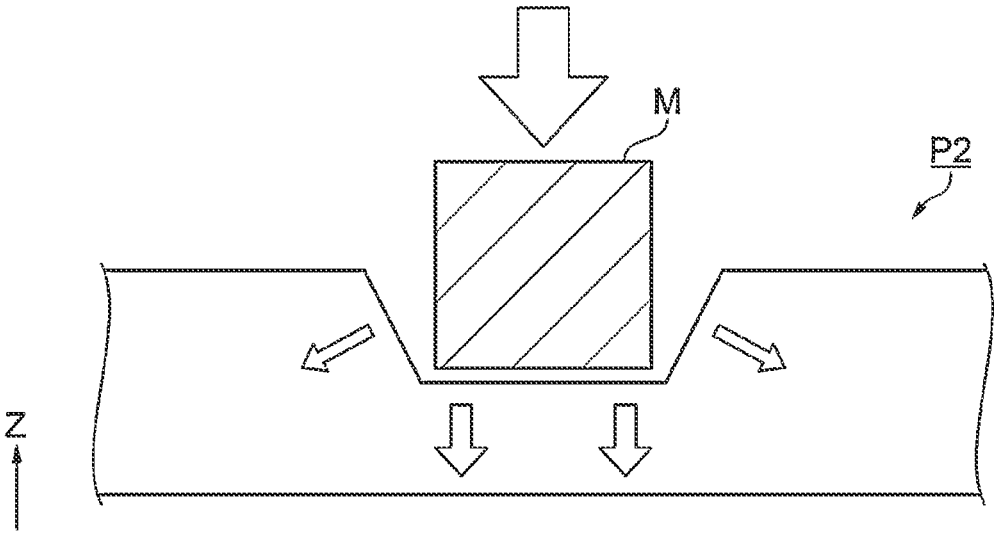
FIG. 6 is a schematic view illustrating the cushioning material in FIG. 5 that conforms to a mold in compression molding.

As illustrated in FIG. 6, when the cushioning material P2 is subjected to compression molding in the −Z direction by using the mold M, an area around the area in contact with the mold M is less indented and the size of the indent is smaller than that in the known cushioning material P3. This is because the compressive force of the mold M is less distributed due to the spreading state and features of the fibers F in the cushioning material P3. Such fibers F enable the cushioning material P2 to have higher mechanical strength and increased conformability to the mold.

According to the method, cushioning materials P having a concave portion are manufactured. According to the embodiments, the following advantages can be achieved.

A cushioning material P having increased mechanical strength can be manufactured. More specifically, a cloth C is defibrated and the defibrated fibers F tend to have relatively short fiber lengths. In addition, a mixture accumulates in air to produce a web w, and thus fibers F are less oriented in a particular direction in the web W. The cushioning material P thus includes the randomly spread relatively short fibers F, which tangle with each other. Accordingly, the cushioning material P has increased mechanical strength as compared with a known cushioning material in which fibers F are layered in a state in which the fibers F are oriented in a particular direction. That is, a method of manufacturing a cushioning material P having increased mechanical strength and the cushioning material P can be provided.

Since the cushioning material P has a concave portion, an object to be packed can be fit into the concave portion and protected. In addition, the cushioning material P having increased mechanical strength enables increased conformability to a mold in the second forming step such as compression molding. Accordingly, a concave portion of a desired shape can be accurately formed.

3. Embodiments and Comparative Example

Hereinafter, effects of the embodiments of the present disclosure will be described more specifically with reference to the embodiments and the comparative example. Table 1 shows the compositions of materials used for manufacture, manufacturing conditions, and evaluation results of the cushioning materials P according to the first and second embodiments and the cushioning material according to the first comparative example. The symbol "–" in the rows of material composition in Table 1 denotes that the corresponding material is not added. It is to be understood that the present disclosure is not limited to the following embodiments.

TABLE 1

| | | First Embodiment | Second Embodiment | First Comparative Example |
|---|---|---|---|---|
| Raw material (Mass %) | Knit fabric | 70 | — | — |
| | plain weave fabric | — | 70 | — |
| | Absorbent cotton | — | — | 70 |
| | Bonding agent | 30 | 30 | 30 |
| Manufacturing method | | α | α | β |
| Mass per unit area (g/m$^2$) | | 1500 | 1500 | 1500 |
| Sheet thickness (mm) | | 15 | 15 | 15 |
| Evaluation result | | A | B | D |

3.1. Manufacturing Cushioning Material

In the first embodiment, a 100% cotton knit fabric was used for a cloth C, which is a raw material of fibers F, as illustrated in Table 1. More specifically, in the crushing step, the knit fabric was crushed into small pieces of irregular shapes having long sides from 1 to 30 mm by using a cutter mill (Makino Mfg. Co., Ltd.). Next, in the defibrating step, the small pieces were subjected to defibrating processing into defibrated material in accordance with a method similar to the defibrating step in the above-described embodiments.

Fibers F were taken from the defibrated material and a length-weighted mean length, a longest fiber length, and an aspect ratio of the fibers were obtained in accordance with the above-described method. As a result, the length-weighted mean length was 32 mm, the longest fiber length was 60 mm, and the aspect ratio of fibers was 0.66.

Next, in the mixing step, the defibrated material, which was fibers F, and polylactic acid, which was a bonding agent, were subjected to air agitation at a mass ratio of seven to three, and a mixture was obtained. In the accumulation step, the mixture was accumulated in air to form a web W having a mass per unit area of 1500 g/m$^2$. In the first forming step, the web W was subjected to hot-press processing under a thermal condition of 135° C. for five minutes and a pressurized condition to have a thickness of 15 mm after manufacture, and a plate-shaped cushioning material P according to the first embodiment was manufactured. The method of manufacturing the plate-shaped cushioning material P according to the first embodiment is referred to as a manufacturing method α.

In the second embodiment, a 100% cotton plain weave fabric was used for a cloth C, which is a raw material of fiber F. More specifically, in the second embodiment, a plate-shaped cushioning material P according to the second embodiment was manufactured in accordance with the manufacturing method α similarly to the plate-shaped cushioning material P according to the first embodiment, other than the change in the raw material for fiber F.

In fiber F taken from the defibrated material according to the second embodiment, the length-weighted mean length was 20 mm, the longest fiber length was 45 mm, and the aspect ratio of fibers was 0.72.

In the first comparative example, a commercially available absorbent cotton was used for a raw material of fiber F. More specifically, the was cut into substantially rectangular small pieces having a size of approximately 30 mm×30 mm by using scissors. Next, compressed air was blown onto the small pieces to disentangle fiber F into single pieces of fiber F. The disentangled fibers F were taken and a length-weighted mean length, a longest fiber length, and an aspect ratio of the fibers were obtained in accordance with the above-described method. As a result, the length-weighted mean length was 28 mm, the longest fiber length was 30 mm, and the aspect ratio of fibers was 0.93.

The entangled fibers F and polylactic acid, which was a bonding agent, were subjected to air agitation at a mass ratio of seven to three, and a mixture was obtained. After the processing, the mixture was mounted on a metal tray and the fibers F were spread while reducing unevenness. This process was repeatedly performed to form a web of the layered mixture on the metal tray. Next, the web was subjected to hot-press processing similarly to the first embodiment. This processing was performed under a thermal condition of 135° C. for five minutes and a pressurized condition to have a thickness of 15 mm after manufacture, and a plate-shaped cushioning material according to the first comparative example was manufactured. The method of manufacturing the plate-shaped cushioning material according to the first comparative example is referred to as a manufacturing method β.

3.2. Evaluation of Cushioning Materials

The cushioning materials P according to the first embodiment and the second embodiment and the cushioning material according to the first comparative example were investigated for their conformability to the mold in the compression molding in the second forming step as indicators of mechanical strength.

More specifically, a plate-shaped cushioning material P was cut into a 10-cm-square for a test specimen. The test specimen was mounted on a bottom plate of a hydraulic press with an iron cylindrical object having a diameter of 4 cm and a height of 3 cm mounted on the center of a main surface of the test specimen. The top plate and the bottom plate of the hydraulic press were preheated to 135° C. Next, the test specimen and the cylindrical object were compressed upward and downward by using the hydraulic press such that the cylindrical object sank into the specimen by one centimeter. After being left in this state for five minutes, the specimen was removed from the hydraulic press with the cylindrical object being mounted thereon and left at room temperature of approximately 25° C.

After being cooled, the cylindrical object was removed from the specimen, and the shape of the concave portion formed on the specimen by the cylindrical object was observed. More specifically, an angle between the bottom of the substantially circular concave portion that was in contact with the bottom of the cylindrical object and the side of the concave portion pressed by the cylindrical object into the specimen was measured. More specifically, a cross section including the center of the concave bottom and the direction of compression in compression molding was cut out. This cross section was printed as an image and the above-described angle was measured by using an angle meter. Each specimen in the embodiments and the comparative example was measured and evaluated by using the following criteria.

Evaluation Criteria

A: The angle is 80° or greater;

B: The angle is 70° or greater and less than 80°;

C: The angle is 60° or greater and less than 70°; and

D: The angle is less than 60°.

Table 1 shows that the cushioning material P according to the first embodiment was rated A and the cushioning material P according to the second embodiment was rated B. The results demonstrate that the first and second embodiments provide increased mechanical strength and high conformability to the mold in compression forming. On the other hand, the cushioning material according to the first comparative example was rated D, and it is difficult to provide increased mechanical strength and its conformability to the mold is lower.

What is claimed is:

1. A method of manufacturing a cushioning material for an object to be packed, the method comprising:

a defibrating step of defibrating, in dry forming, a cloth to produce fibers that have an aspect ratio of 0.9 or less;

a mixing step of mixing the fibers with a bonding agent to produce a mixture;

an accumulation step of accumulating the mixture in air to produce a web;

a first forming step of pressurizing and heating the web to form the cushioning material; and a second forming step of, after the first forming step, forming a concave portion by pressurizing a predetermined portion of the cushioning material such that the concave portion has a shape conforming to a three-dimensional shape of the object to be packed.

2. The method of manufacturing a cushioning material for an object to be packed according to claim 1, wherein the cloth contains cotton or wool.

3. The method of manufacturing a cushioning material for an object to be packed according to claim 1, wherein in the second forming step, the concave portion is formed by the pressurizing using a mold.

4. A method of manufacturing a packed object, the method comprising:

the method of manufacturing the cushioning material for the object to be packed according to claim 1; and packing, in the concave portion, the object to be packed to manufacture the packed object.

5. A method of manufacturing a cushioning material for an object to be packed, the method comprising:

a defibrating step of defibrating, in dry forming, a knit fabric to produce fibers;

a mixing step of mixing the fibers with a bonding agent to produce a mixture;

an accumulation step of accumulating the mixture in air to produce a web;

a first forming step of pressurizing and heating the web to form the cushioning material; and a second forming step of, after the first forming step, forming a concave portion by pressurizing a predetermined portion of the cushioning material such that the concave portion has a shape conforming to a three-dimensional shape of the object to be packed.

6. The method of manufacturing a cushioning material for an object to be packed according to claim 5, wherein the knit fabric contains cotton or wool.

7. The method of manufacturing a cushioning material for an object to be packed according to claim 5, wherein in the second forming step, the concave portion is formed by the pressurizing using a mold.

8. A method of manufacturing a packed object, the method comprising:

the method of manufacturing the cushioning material for the object to be packed according to claim 5; and packing, in the concave portion, the object to be packed to manufacture the packed object.

* * * * *